US008630573B2

(12) United States Patent
Iio et al.

(10) Patent No.: US 8,630,573 B2
(45) Date of Patent: Jan. 14, 2014

(54) IMAGE FORMING METHOD, IMAGE FORMING APPARATUS, VARNISH APPLICATOR, AND TONER

(75) Inventors: Masato Iio, Kanagawa (JP); Tsuyoshi Asami, Kanagawa (JP); Kentarou Matsumoto, Tokyo (JP); Shinya Kobayashi, Kanagawa (JP); Akio Tsujita, Kanagawa (JP); Kathuhiro Shinohara, Kanagawa (JP); Tadashi Kasai, Kanagawa (JP); Takashi Bisaiji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 241 days.

(21) Appl. No.: 13/064,134

(22) Filed: Mar. 8, 2011

(65) Prior Publication Data

US 2011/0223527 A1 Sep. 15, 2011

(30) Foreign Application Priority Data

Mar. 15, 2010 (JP) ..... 2010-057764

(51) Int. Cl.
*G03G 15/08* (2006.01)

(52) U.S. Cl.
USPC ..... 399/341; 399/222; 399/252; 430/108.8

(58) Field of Classification Search
USPC ..... 399/222, 252, 341; 430/108.8
See application file for complete search history.

(56) References Cited

U.S. PATENT DOCUMENTS

2007/0238813 A1* 10/2007 Anderson et al. ..... 524/31
2008/0069613 A1* 3/2008 Anderson et al. ..... 399/341
2009/0155710 A1* 6/2009 Aoki et al. ..... 430/111.4

FOREIGN PATENT DOCUMENTS

JP 2522333 B 5/1996
JP 3570853 B 7/2004
JP 2007277547 A 10/2007
JP 2009-073942 * 4/2009 ..... C09D 4/00

OTHER PUBLICATIONS

Translation of JP 2009-073942 published Apr. 2009.*
Euclid Coating Systems 3-roll Offset Gravure Lab Coater Information Sheet (http://www.euclidlabcoaters.com/offset_coater.htm) 2012.*
Abstract of JP 10-309876 published on Nov. 24, 1998.
Abstract of JP 01-163747 published on Jun. 28, 1989.

* cited by examiner

*Primary Examiner* — Peter Vajda
(74) *Attorney, Agent, or Firm* — Harnesss, Dickey & Pierce P.L.C.

(57) ABSTRACT

An image forming method including forming a toner image on a transfer medium with a toner comprising a wax having a polar group, and applying a varnish to the toner image. The wax may be a plant wax having an ester group, a wax having a polar group derived from a fatty acid, an oxidized wax, or a mixture thereof. The varnish may include a surfactant, such as a polyoxyethylene glycol, and may be photocurable.

17 Claims, 2 Drawing Sheets

IMAGE FORMING METHOD, IMAGE FORMING APPARATUS, VARNISH APPLICATOR, AND TONER

CROSS-REFERENCE TO RELATED APPLICATIONS

The present patent application claims priority pursuant to 35 U.S.C. §119 from Japanese Patent Application No. 2010-057764, filed on Mar. 15, 2010, which is hereby incorporated by reference herein in its entirety.

BACKGROUND

1. Field of the Invention

The present invention relates to an image forming method and an image forming apparatus that form a toner image and apply a varnish to the toner image, a varnish applicator that applies a varnish to a toner image, and a toner for use in the image forming apparatus.

2. Description of the Background

On the covers of various catalogs and books, images and texts are generally printed. Some of the printed covers need to be protected from water or contamination or to have appropriate gloss in accordance with their purpose of use. In such cases, the surfaces of the printed covers are processed by overprint, vinyl coating, press coating, film pasting, or the like.

Recently, on-demand printing is widely employed because it meets recent demand for a print system which can output variable information at high speed. On the other hand, protective film layers formed with varnishes become popular recently.

On-demand printing apparatuses are of two main types: electrophotographic apparatuses and inkjet apparatuses. Electrophotographic apparatuses that use toner are more widely used for the purpose of printing images.

In electrophotography, an image is formed by adhering a colored powder, what is called toner, to a recording medium. The toner is generally fixed on the recording medium by a fixing device which includes a roller, the surface of which is comprised of a material having excellent releasing property or is coated with a large amount of oil. When a large amount of oil is applied to the surface of the roller, disadvantageously, the oil is likely to contaminate the recording medium such as paper. Additionally, the fixing device is made more complicated and larger because an extra space to contain the oil is necessarily provided.

For the above reasons, there is a need for a more simplified fixing device which does not use oil (hereinafter "oilless fixing device"). Simultaneously, there is a need for a toner applicable to the oilless fixing device. In response to this need, a toner including a wax has been proposed. With respect to the protective film layer, several commercially-available varnishes are used in offset printing. However, some varnishes are incompatible with a wax included in a toner. Such varnishes do not yield sufficient results when used in combination with an electrophotographic apparatus using such a toner including a wax.

In attempting to solve the problem of incompatibility between varnish and wax, Japanese Patent Application Publication No. 2007-277547 discloses a novel varnish composition and its preparing method. The disclosed technique improves the compatibility by covering a print on which a fixing oil is applied with a water-based covering agent including no ammonia and having low static surface tension. Japanese Patent Application Publication No. H10-309876 discloses a resin layer forming device and an image forming apparatus equipped with the device. The resin layer forming device forms a silicone resin layer on a printed surface to protect it from contamination and water and to increase gloss. Japanese Patent No. 2522333 discloses a metal container having printing on its surface and a printing method for metal containers. The disclosed technique employs electrophotography that is capable of efficiently printing wide variety of printings in small amount, in combination with varnish treatment that protects a toner layer and improve gloss of the toner layer.

However, the above-described techniques limit usable types of toner and varnishes to specific combinations. Even when a varnish can be applied to a toner image, in some cases, adhesiveness between the varnish and the toner image is weak and the varnish peels off from the toner image. In such cases, the varnish no longer protects the toner image nor improves gloss of the toner.

In accordance with recent tendency that the mainstream is switching from offset printing to electrophotography that is capable of efficiently printing wide variety of printings in small amount, it is necessary that wider variety of varnishes and toners can be usable in various combinations.

SUMMARY

Exemplary aspects of the present invention are put forward in view of the above-described circumstances, and provide a novel image forming method, image forming apparatus, and varnish applicator that protect printed surfaces of toner images and improves gloss of the printed surfaces for an extended period of time.

In one exemplary embodiment, a novel image forming method includes forming a toner image on a transfer medium with a toner comprising a wax having a polar group, and applying a varnish to the toner image.

In another exemplary embodiment, a novel image forming apparatus includes an image bearing member to bear an electrostatic latent image, a developing device to develop the electrostatic latent image into a toner image with a toner comprising a wax having a polar group, and a varnish applicator to apply a varnish to the toner image.

In yet another exemplary embodiment, a novel varnish applicator includes an applying roller to apply a varnish including a surfactant to a toner image on a transfer medium, and a pressing roller to press against the applying roller to form a nip therebetween, through which the transfer medium having the toner image thereon passes.

Other exemplary aspects of the present invention are put forward in view of the above-described circumstances, and provide a novel toner that has better compatibility with varnishes, including a binder resin and a wax having a polar group.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
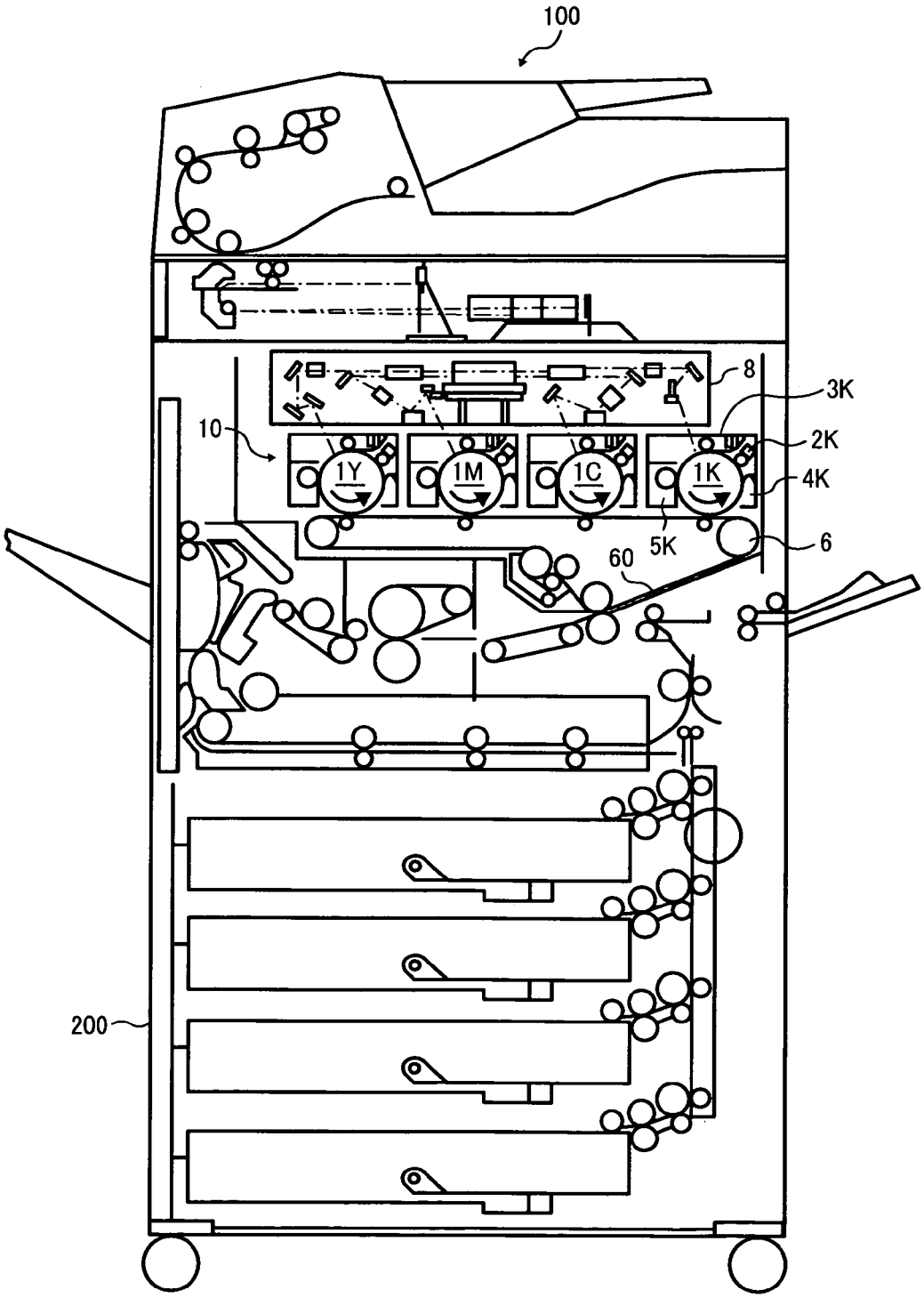
FIG. 1 schematically illustrates an image forming apparatus according to exemplary embodiments of the invention.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

FIG. 1 schematically illustrates an image forming apparatus according to exemplary embodiments of the invention. The additional characters Y, M, C, and K representing toner colors of yellow, magenta, cyan, and black, respectively, are added or omitted as appropriate in the descriptions below. Usable colors of toners are not limited to the above combination.

An image forming apparatus 100 includes an electrostatic latent image forming device 10 including image bearing members 1Y, 1M, 1C, and 1K, each having the same configuration, an irradiator 8, a transfer device 6, and a fixing device. Around each of the image bearing members 1, a charging roller 3, a developing device 5, a cleaning device 4, and a protective layer forming device 2 are provided. The image forming apparatus 100 may optionally include other devices, such as a neutralization device, a recycle device, and a controller, if needed.

An image forming method according to exemplary embodiments of the invention include an electrostatic latent image forming process, a developing process, a transfer process, a protective layer forming process, and a fixing process, and preferably a cleaning process. The image forming method may optionally include other processes, such as a neutralization process, a recycle process, and a control process, if needed.

The image forming method according to exemplary embodiments of the invention is preferably practiced by the image forming apparatus according to exemplary embodiments of the invention. The electrostatic latent image forming process is practiced by the electrostatic latent image forming device, the developing process is practiced by the developing device, the transfer process is practiced by the transfer device, the protective layer forming process is practiced by the protective layer forming device, the fixing process is practiced by the fixing device, and the cleaning process is practiced by the cleaning device. The neutralization process is practiced by the neutralization device, the recycle process is practiced by the recycle device, and the control process is practiced by the controller.

The above described processes and devices are described in detail below.

The electrostatic latent image forming process is a process which forms an electrostatic latent image on an image bearing member.

There is not a limit on material, shape, structure, or size on the image bearing member. Preferably, the image bearing member has a drum-like shape and is comprised of an inorganic photoconductor, such as amorphous silicone and selenium, or an organic photoconductor, such as polysilane and phthalopolymethine.

The image bearing member may include a conductive substrate and a photosensitive layer, and optional layers, if needed.

The photosensitive layer may be a single layer including both a charge generation material and a charge transport material, a regular multilayer including a charge generation layer and a charge transport layer thereon, or a reverse multilayer including a charge transport layer and a charge generation layer formed thereon. To improve mechanical strength, abrasion resistance, gas resistance, and cleanability, an outermost surface layer may be further provided on the photosensitive layer. Additionally, an undercoat layer may be provided between the photosensitive layer and the conductive substrate. Each layers may include a plasticizer, an antioxidant, and/or a leveling agent.

The conductive substrate may be comprised of a conductive material having a volume resistivity not greater than $1.0\times10^{10}$ Ω·cm. For example, plastic films, plastic cylinders, or paper sheets, on the surface of which a metal (such as aluminum, nickel, chromium, nichrome, copper, gold, silver, platinum, and the like, or a metal oxide such as tin oxide, and indium oxide) is formed by deposition or sputtering, can be used as the conductive substrate. Additionally, a metal cylinder which is prepared by tubing a metal (such as aluminum, aluminum alloy, nickel, and stainless steel) by drawing ironing, impact ironing, extruded ironing, and extruded drawing, and then treating the surface of the tube by cutting, super finishing, polishing, and the like treatments, can be also used as the conductive substrate.

The drum-like conductive substrate preferably has a diameter of 20 to 150 mm, more preferably 24 to 100 mm, and most preferably 28 to 70 mm. When the diameter of the drum-like conductive substrate is too small, it is spatially difficult to arrange the processes of charging, exposure, developing, transfer, and cleaning around it. When the diameter of the drum-like conductive substrate is too large, the image forming apparatus becomes too large. When the image forming apparatus includes multiple image forming members arranged in tandem, the drum-like conductive substrate preferably has a diameter not greater than 70 mm, and more preferably not greater than 60 mm.

In addition, an endless nickel belt disclosed in Examined Japanese Application Publication No. S52-36016 and an endless stainless belt can be also used as the conductive substrate.

The undercoat layer may be either a single layer or a multilayer. For example, the undercoat layer may be a layer comprised primarily of a resin, or a mixture of a white pigment and a resin. Also, the undercoat layer may be a metal oxide film formed by chemically or electrochemically oxidizing the surface of the conductive substrate. Preferably, the undercoat layer may be a layer comprised primarily of a resin.

Specific examples of usable white pigments include, but are not limited to, metal oxides such as titanium oxide, aluminum oxide, zirconium oxide, and zinc oxide. Among these metal oxides, titanium oxide is preferable because it is excellent in preventing charge injection from the conductive substrate.

Specific examples of usable resins include, but are not limited to, thermoplastic resins such as polyamide, polyvinyl alcohol, casein, and methyl cellulose; and thermosetting resins such as acrylic, phenol, melamine, alkyd, unsaturated polyester, and epoxy. Two or more of these resins can be used in combination.

The undercoat layer preferably has a thickness of 0.1 to 10 μm, and more preferably 1 to 5 μm.

Specific preferred examples of suitable charge generation materials include, but are not limited to, organic pigments and dyes such as azo pigments (e.g., monoazo pigments, bisazo pigments, trisazo pigments, tetrakisazo pigments), triarylmethane dyes, thiazine dyes, oxazine dyes, xanthene dyes, cyanine dyes, styryl dyes, pyrylium dyes, quinacridone pigments, indigo pigments, perylene pigments, polycyclic quinone pigments, benzimidazole pigments, indanthrone pigments, squarylium pigments, phthalocyanine pigments; and inorganic materials such as selenium, selenium-arsenic, selenium-tellurium, cadmium sulfide, zinc oxide, titanium oxide, and amorphous silicone. Two or more of these materials can be used in combination.

Specific preferred examples of suitable charge transport materials include, but are not limited to, anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives. Two or more of these materials can be used in combination.

The photosensitive layer may be formed of an electrically-insulative binder resin such as a thermoplastic resin, a thermosetting resin, a photo-curable resin, and a photoconductive resin. Specific preferred examples of suitable binder resins include, but are not limited to, thermoplastic resins such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, acrylic resin, methacrylic resin, polystyrene, polycarbonate, polyarylate, polysulfone, polyether sulfone, and ABS resin; thermosetting resins such as phenol resin, epoxy resin, urethane resin, melamine resin, isocyanate resin, alkyd resin, silicone resin, and thermosetting acrylic resin; and polyvinyl carbazole, polyvinyl anthracene, and polyvinyl pyrene. Two or more of these resins can be used in combination.

Specific preferred examples of suitable antioxidants include, but are not limited to, phenol compounds, paraphenylenediamines, hydroquinones, organic sulfur compounds, and organic phosphor compounds.

Specific examples of the phenol compounds include, but are not limited to, 2,6-di-t-butyl-p-cresol, butylated hydroxyanisole, 2,6-di-t-butyl-4-ethylphenol, stearyl-β-(3,5-di-t-butyl-4-hydroxyophenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid]glycol ester, and tocopherols.

Specific examples of the paraphenylenediamines include, but are not limited to, N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Specific examples of the hydroquinones include, but are not limited to, 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Specific examples of the organic sulfur compounds include, but are not limited to, dilauryl-3,3'-thiodipropionate, distearyl-3,3'-thiodipropionate, and ditetradecyl-3,3'-thiodipropionate.

Specific examples of the organic phosphor compounds include, but are not limited to, triphenylphosphine, tri(nonylphenyl)phosphine, tri(dinonylphenyl)phosphine, tricresylphosphine, and tri(2,4-dibutylphenoxy)phosphine.

The above-described antioxidants are typically used for rubbers, plastics, and oils and fats, and are commercially available. The content of the antioxidant in the layer is preferably 0.01 to 10% by weight based on total weight of the layer.

Specific preferred examples of suitable plasticizers include, but are not limited to, dibutyl phthalate and dioctyl phthalate, which are typically used for resins. The content of the plasticizer is preferably 0 to 30 parts by weight based on 100 parts by weight of the binder resin.

Specific preferred examples of suitable leveling agents include, but are not limited to, silicone oils such as dimethyl silicone oil and methyl phenyl silicone oil, and polymers or oligomers having a side chain having a perfluoroalkyl group. The content of the leveling agent is preferably 0 to 1 part by weight based on 100 parts by weight of the binder resin.

The electrostatic latent image forming device forms an electrostatic latent image by uniformly charging a surface of the image bearing member and irradiating the charged surface with light containing image information. The electrostatic latent image forming device comprises a charger that uniformly charges a surface of the image bearing member and an irradiator that irradiates the charged surface with light containing image information.

The charger charges a surface of the image bearing member by applying a voltage thereto.

The charger may be, for example, a contact charger equipped with a conductive or semiconductive roll, brush, film, or rubber blade, or a non-contact charger such as corotron and scorotron that use corona discharge. The charger is preferably equipped with a voltage applicator that applies a voltage including alternating-current components.

The irradiator irradiates the charged surface of the image bearing member with light containing image information.

The irradiator may be, for example, a radiation optical type, a rod lens array type, a laser optical type, or a liquid crystal shutter optical type.

The image bearing member may be irradiated with light from the reverse surface (back surface) side thereof.

The developing process is a process which develops the electrostatic latent image into a toner image that is visible.

The developing device develops the electrostatic latent image with a toner or a developer to form a toner image.

The developing device preferably includes a container that contains a toner or developer and a developing unit that supplies the toner or developer to the electrostatic latent image with or without contacting the electrostatic latent image.

The toner preferably has an average circularity of 0.93 to 1.00, more preferably 0.95 to 0.99. The circularity indicates surface roughness of a toner particle. When the toner particle is a sphere, the circularity is 1.00. As the surface becomes rougher, the circularity becomes smaller.

The circularity SR is defined by the following formula (1):

$$SR=Cs/Cp \quad (1)$$

wherein Cs represents a circumferential length of a circle having the same area as a projected image of a toner particle and Cp represents a circumferential length of the projected image of the toner particle. When the average circularity is 0.93 to 1.00, it means that the toner particles have a smooth surface. Such toner particles can be efficiently transferred from the image bearing member because the contact area between each toner particles or between the toner particle and the image bearing member is small. Additionally, such toner particles do not produce abnormal image because they can be stably agitated in the developing device with only a small agitation torque. Furthermore, such toner particles with smooth surface do not produce defective image because they can be uniformly pressed against a recording medium in the transfer process, forming uniform dots. Moreover, such toner particles with smooth surface do not scratch or abrade the surface of the image bearing member.

The circularity SR can be measured with a flow type particle image analyzer FPIA-1000 from Sysmex Corporation in the following procedure. First, 0.1 to 0.5 ml of a surfactant (preferably an alkylbenzene sulfonate) as a dispersant and 0.1 to 0.5 g of a toner are added to 100 to 150 ml of water, from which solid impurities have been removed, in a container. The toner is dispersed in the water using an ultrasonic disperser for about 1 to 3 minutes to prepare a suspension. The suspension concentration is adjusted such that 3,000 to 10,000 toner particles are included per micro-liter. The suspension is then subjected to measurement of shape and size of the toner particles using the flow type particle image analyzer.

The toner preferably has a weight average particle diameter (D4) of 3 to 10 μm, more preferably 4 to 8 μm. Such a toner has excellent dot reproducibility because the particle size is sufficiently smaller than micro dots forming a latent image. When the weight average particle diameter (D4) is too small, the toner particles may be inefficiently transferred from the image bearing member, or may be insufficiently removed with a blade. When the weight average particle diameter (D4) is too large, it is difficult to prevent the occurrence of text or line scattering in the produced image.

The ratio (D4/D1) of the weight average particle diameter (D4) to the number average particle diameter (D1) is preferably 1.00 to 1.40, more preferably 1.00 to 1.30. As the ratio (D4/D1) approaches 1, the particle size distribution of the toner becomes narrower. When the ratio (D4/D1) is between 1.00 and 1.40, toner particles are not selected depending on the particle size when developing a latent image, thus producing a reliable image. When the ratio (D4/D1) is between 1.00 and 1.40, the frictional charge quantity distribution is as narrow as the particle size distribution, thus preventing the occurrence of fogging in the produced image. Toner particles having a uniform particle diameter develop latent image dots at high dot reproducibility by densely and orderly aligning.

The weight average particle diameter (D4) and the number average particle diameter (D1) can be measured by a Coulter counter method using a measuring device COULTER COUNTER TA-II or COULTER MULTISIZER II (both from Beckman Coulter, Inc.).

The following is an exemplary measurement procedure. First, 0.1 to 5 ml of a surfactant (preferably an alkylbenzene sulfonate) as a dispersant is added to 100 to 150 ml of an electrolyte. The electrolyte is an aqueous solution including about 1% of the first grade sodium chloride, such as ISOTON-II (from Beckman Coulter, Inc.). Next, 2 to 20 mg of a toner is added to the electrolyte. The toner is dispersed in the electrolyte using an ultrasonic disperser for about 1 to 3 minutes to prepare a suspension. The suspension is then subjected to measurement of volume and number distributions of the toner particles using the measuring device equipped with a 100-μm aperture. The weight average particle diameter (D4) and the number average particle diameter (D1) are calculated from the volume and number distributions measured above.

The channels include the following 13 channels: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Accordingly, particles having a particle diameter of not less than 2.00 μm and less than 40.30 μm are measuring targets.

A nearly spherical toner can be prepared by subjecting toner compositions including a polyester prepolymer having a nitrogen-containing functional group, a polyester, a colorant, and a release agent to cross-linking and/or elongation reactions. The resulting toner has a relatively hard surface and prevents the occurrence of hot offset in which melted toner particles adhering to the fixing device are retransferred onto a recording medium.

The polyester prepolymer may be, for example, a polyester prepolymer (A) having an isocyanate group. A compound capable of cross-linking and/or elongating with the polyester prepolymer (A) may be, for example, an amine (B).

The polyester prepolymer (A) may be, for example, a polyester having an active hydrogen group, which is a polycondensation product of a polyol (1) with a polycarboxylic acid (2), further modified with a polyisocyanate (3). The active hydrogen group may be, for example, a hydroxyl group (e.g., an alcoholic hydroxyl group, a phenolic hydroxyl group), an amino group, a carboxyl group, or a mercapto group, and is preferably an alcoholic hydroxyl group.

The polyol (1) may be, for example, a diol (1-1) or a polyol (1-2) having 3 or more valences. A diol (1-1) alone or a mixture of a diol (1-1) with a small amount of a polyol (1-2) having 3 or more valences are preferable.

Specific examples of the diol (1-1) include, but are not limited to, alkylene glycols (e.g., ethylene glycol, 1,2-propylene glycol, 1,3-propylene glycol, 1,4-butanediol, 1,6-hexanediol), alkylene ether glycols (e.g., diethylene glycol, triethylene glycol, dipropylene glycol, polyethylene glycol, polypropylene glycol, polytetramethylene ether glycol), alicyclic diols (e.g., 1,4-cyclohexanedimethanol, hydrogenated bisphenol A), bisphenols (e.g., bisphenol A, bisphenol F, bisphenol S), alkylene oxide (e.g., ethylene oxide, propylene oxide, butylene oxide) adducts of the alicyclic diols, and alkylene oxide (e.g., ethylene oxide, propylene oxide, butylene oxide) adducts of the bisphenols. Among these diols, alkylene glycols having 2 to 12 carbon atoms and alkylene oxide adducts of bisphenols are preferable; and alkylene oxide adducts of bisphenols and mixtures of an alkylene oxide adducts of bisphenol with an alkylene glycol having 2 to 12 carbon atoms are more preferable.

Specific examples of the polyol (1-2) having 3 or more valences include, but are not limited to, polyvalent aliphatic alcohols (e.g., glycerin, trimethylolethane, trimethylolpropane, pentaerythritol, sorbitol), polyphenols (e.g., trisphenol PA, phenol novolac, cresol novolac), and alkylene oxide adducts of the polyphenols.

The polycarboxylic acid (2) may be, for example, a dicarboxylic acid (2-1) or a polycarboxylic acid (2-2) having 3 or more valences. A dicarboxylic acid (2-1) alone or a mixture of a dicarboxylic acid (2-1) with a small amount of a polycarboxylic acid (2-2) having 3 or more valences are preferable.

Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these dicarboxylic acids, alkenylene dicarboxylic acids having 4 to 20 carbon atoms and aromatic dicarboxylic acids having 8 to 20 carbon atoms are preferable.

Specific examples of the polycarboxylic acid (2-2) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acid (2).

The equivalent ratio [OH]/[COOH] of hydroxyl groups [OH] in the polyol (1) to carboxyl groups [COOH] in the polycarboxylic acid (2) is preferably 2/1 to 1/1, more preferably 1.5/1 to 1/1, and most preferably 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., α,α,α',α'-tetramethylxylylene diisocyanate), isocyanurates, and the above polyisocyanates in which the isocyanate group is blocked with a phenol derivative, an oxime, or a caprolactam. Two or more of these materials can be used in combination.

The equivalent ratio [NCO]/[OH] of isocyanate groups [NCO] in the polyisocyanate (3) to hydroxyl groups [OH] in the polyester having a hydroxyl group is preferably 5/1 to 1/1, more preferably 4/1 to 1.2/1, and most preferably from 2.5/1 to 1.5/1. When the equivalent ratio [NCO]/[OH] is too large, low-temperature fixability of the resulting toner may be poor. When the equivalent ratio [NCO]/[OH] is too small, hot offset resistance of the resulting toner may be poor because the content of urea in the resulting modified polyester is too small.

The polyester prepolymer (A) having an isocyanate group preferably includes the polyisocyanate (3) units in an amount of 0.5 to 40% by weight, more preferably 1 to 30% by weight, and most preferably 2 to 20% by weight. When the amount is too small, hot offset resistance, heat-resistant storage stability, and low-temperature fixability of the resulting toner may be poor. When the amount is too large, low-temperature fixability of the resulting toner may be poor.

The average number of isocyanate groups included in one molecule of the polyester prepolymer (A) is preferably 1 or more, more preferably 1.5 to 3, and most preferably 1.8 to 2.5. When the number of isocyanate groups per molecule is too small, hot offset resistance of the resulting toner may be poor because the molecular weight of the resulting urea-modified polyester is too small.

The amine (B) may be, for example, a diamine (B1), a polyamine (B2) having 3 or more valences, an amino alcohol (B3), an amino mercaptan (B4), an amino acid (B5), or a blocked amine (B6) in which the amino group in any of the amines (B1) to (B5) is blocked. Specific examples of the diamine (B1) include, but are not limited to, aromatic diamines (e.g., phenylenediamine, diethyltoluenediamine, 4,4'-diaminodiphenylmethane); alicyclic diamines (e.g., 4,4'-diamino-3,3'-dimethyldicyclohexylmethane, diamine cyclohexane, isophoronediamine); and aliphatic diamines (e.g., ethylenediamine, tetramethylenediamine, hexamethylenediamine). Specific examples of the polyamine (B2) having 3 or more valences include, but are not limited to, diethylenetriamine and triethylenetetramine. Specific examples of the amino alcohol (B3) include, but are not limited to, ethanolamine and hydroxyethylaniline. Specific examples of the amino mercaptan (B4) include, but are not limited to, aminoethyl mercaptan and aminopropyl mercaptan. Specific examples of the amino acid (B5) include, but are not limited to, aminopropionic acid and aminocaproic acid. Specific examples of the blocked amine (B6) include, but are not limited to, ketimine compounds obtained from the above-described amines (B1) to (B5) and ketones (e.g., acetone, methyl ethyl ketone, methyl isobutyl ketone), and oxazoline compounds. Among these amines (B), a diamine (B1) alone and a mixture of a diamine (B1) with a small amount of a polyamine (B2) having 3 or more valences are preferable.

To control the molecular weight of the resulting urea-modified polyester, a reaction terminator can be used. Specific preferred examples of suitable reaction terminators include, but are not limited to, monoamines (e.g., diethylamine, dibutylamine, butylamine, laurylamine) and blocked monoamines (e.g., ketimine compounds).

The equivalent ratio [NCO]/[NHx] of isocyanate groups [NCO] in the polyester prepolymer (A) to amino groups [NHx] in the amine (B) is preferably 1/2 to 2/1, more preferably 1.5/1 to 1/1.5, and most preferably 1.2/1 to 1/1.2. When the equivalent ratio [NCO]/[NHx] is too large or small, hot offset resistance of the resulting toner may be poor because the molecular weight of the resulting urea-modified polyester (i) is too small.

The urea-modified polyester (i) may include urethane bonds other than urea bonds. In this case, the molar ratio of urea bonds to urethane bonds is preferably 100/0 to 10/90, more preferably 80/20 to 20/80, and most preferably 60/40 to 30/70. When the molar ratio is too small, hot offset resistance of the resulting toner may be poor.

The urea-modified polyester (i) preferably has a weight average molecular weight of 10,000 or more, more preferably 20,000 to 10,000,000, and most preferably 30,000 to 1,000,000. When the weight average molecular weight is too small, hot offset resistance of the resulting toner may be poor.

The urea-modified polyester (i) is not limited in molecular weight when used in combination with the later-described unmodified polyester (ii). When the urea-modified polyester (i) is used alone, the urea-modified polyester (i) preferably has a number average molecular weight of 1,000 to 10,000, more preferably 2,000 to 8,000. When the number average molecular weight is too large, low-temperature fixability of the resulting toner may be poor and the resulting image may have low gloss.

As described above, the urea-modified polyester (i) can be used in combination with an unmodified polyester (ii). The combination of the urea-modified polyester (i) and the unmodified polyester (ii) improves gloss of the resulting image compared to a case in which the urea-modified polyester (i) is used alone. Similar to the urea-modified polyester (i), the unmodified polyester (ii) may be a polycondensation product of the polyol (1) with the polycarboxylic acid (2). The unmodified polyester (ii) may be modified with chemical bond other than urea bond, such as urethane bond. It is preferable that the unmodified polyester (i) and the urea-modified polyester (ii) are at least partially compatible with each other from the viewpoint of low-temperature fixability and hot offset resistance of the toner.

Therefore, the unmodified polyester (i) and the urea-modified polyester (ii) preferably have a similar chemical composition. The weight ratio of the urea-modified polyester (i) to the unmodified polyester (ii) is preferably 5/95 to 80/20, more preferably 5/95 to 30/70, much more preferably 5/95 to 25/75, and most preferably 7/93 to 20/80. When the ratio of the urea-modified polyester (i) is too small, hot offset resistance, heat-resistant storage stability, and low-temperature fixability of the resulting toner may be poor.

The unmodified polyester (ii) preferably has a peak molecular weight of 1,000 to 30,000, more preferably 1,500 to 10,000, and most preferably 2,000 to 8,000. When the peak molecular weight is too small, heat-resistant storage stability of the resulting toner may be poor. When the peak molecular weight is too large, low-temperature fixability of the resulting toner may be poor. The unmodified polyester (ii) preferably has a hydroxyl value of 5 or more, more preferably 10 to 120, and most preferably 20 to 80. When the hydroxyl value is too small, hot offset resistance and low-temperature fixability of the resulting toner may be poor. The unmodified polyester (ii) preferably has an acid value of 1 to 30, more preferably 5 to 20. Within the above range, the resulting toner may be negatively chargeable.

The binder resin preferably has a glass transition temperature (Tg) of 50 to 70° C., more preferably 55 to 65° C. When the glass transition temperature is too low, the resulting toner may cause blocking when stored at high temperatures. When the glass transition temperature is too high, low-temperature fixability of the resulting toner may be poor. Although having a lower glass transition temperature than typical polyester-based toners, the toner according to this specification has good heat-resistant storage stability because of including the urea-modified polyester (i).

A temperature (TG') at which the storage elastic modulus of the binder resin becomes 10,000 dyne/$cm^2$ at a frequency of 20 Hz is preferably 100° C. or more, more preferably 110 to 200° C. When the temperature (TG') is too low, hot offset resistance of the resulting toner may be poor.

A temperature (Tη) at which the viscosity of the binder resin becomes 1,000 poises at a frequency of 20 Hz is preferably 180° C. or less, more preferably 90 to 160° C. When the temperature (Tη) is too high, low-temperature fixability of the resulting toner may be poor. From the viewpoint of low-temperature fixability and hot offset resistance, TG' is preferably higher than T. In other words, the difference (TG'-Tη) between TG' and Tη is preferably 0° C. or more, more preferably 10° C. or more, and most preferably 20° C. or more. From the viewpoint of heat-resistant storage stability and low-temperature fixability, the difference between TG' and Tη is preferably 0 to 100° C., more preferably 10 to 90° C., and most preferably 20 to 80° C.

The binder resin can be also prepared by the following procedure.

First, a polyol (1) and a polycarboxylic acid (2) are heated to 150 to 280° C. in the presence of an esterification catalyst (e.g., tetrabutoxy titanate, dibutyltin oxide), while optionally reducing pressure and removing the produced water, to obtain a polyester having a hydroxyl group. Next, the polyester having a hydroxyl group is reacted with a polyisocyanate (3) at 40 to 140° C., to obtain a prepolymer (A) having an isocyanate group. Next, the prepolymer (A) is reacted with an amine (B) at 0 to 140° C., to obtain a urea-modified polyester (i). When reacting the polyisocyanate (3) with the polyester or reacting the amine with the prepolymer (A), solvents can be used, of needed.

Specific examples of usable solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran), which are inactive against the polyisocyanate (3).

When the unmodified polyester (ii) is used in combination, the unmodified polyester (ii) is prepared in a similar manner to the polyester having a hydroxyl group. The unmodified polyester (ii) is then added to the reaction product mixture liquid including the modified polyester (i).

The toner for use in the present invention can be prepared as follows.

The toner can be prepared by reacting the prepolymer (A) having an isocyanate group with the amine (B) in an aqueous medium, or using the urea-modified polyester (i) previously prepared. To form a stable dispersion of the prepolymer (A) or the urea-modified polyester (i), toner components including the prepolymer (A) or the urea-modified polyester (i) are preferably dispersed in the aqueous medium while applying a shearing force thereto.

The prepolymer (A) and other toner components, such as a colorant or a colorant master batch, a release agent, a charge controlling agent, and the unmodified polyester (ii), may be mixed at the time they are dispersed in the aqueous medium. However, it is more preferable that the toner components are previously mixed with each other and the resulting mixture is then dispersed in the aqueous medium. The colorant, release agent, and charge controlling agent are not necessarily mixed with other toner components at the time they are dispersed in the aqueous medium, and may be added to the resulting particles in a later process. For example, the resulting particles including no colorant can be dyed with a colorant.

The aqueous medium may be, for example, water alone or a mixture of water with a water-miscible solvent. Specific preferred examples of suitable water miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

The amount of the aqueous medium is preferably 50 to 2,000 parts by weight, more preferably 100 to 1,000 parts by weight, based on 100 parts by weight of the toner components. When the amount of the aqueous medium is too small, the toner components may not be finely dispersed, and the resulting toner particles may not have a desired particle size. When the amount of the aqueous medium is too large, manufacturing cost may increase.

The aqueous medium preferably contains a dispersant. The dispersant stabilizes the dispersion and makes the resulting particles have a narrower size distribution.

The toner components are dispersed in the aqueous medium using a low-speed shearing disperser, a high-speed shearing disperser, a frictional disperser, a high-pressure jet disperser, or an ultrasonic disperser, for example. A high-speed shearing disperser is preferable when controlling the particle diameter of the dispersing oil droplets into 2 to 20 μm. As for the high-speed shearing disperser, the revolution is preferably 1,000 to 30,000 rpm, and more preferably 5,000 to 20,000 rpm. The dispersing time is preferably 0.1 to 5 minutes for a batch type. The dispersing temperature is preferably 0 to 150° C., and more preferably 40 to 98° C. As the temperature becomes higher, the viscosity of the dispersion of toner components becomes lower, which is easier to disperse in the aqueous medium.

The amine (B) may be previously mixed with the toner components including the prepolymer (A) before they are added to the aqueous medium. Alternatively, the amine (B) may be added to the aqueous medium after the toner components including the polyester prepolymer (A) are dispersed therein. In the latter case, the resulting urea-modified polyester resin is dominantly formed at the surface of the toner particle, generating a concentration gradient of urea bonds within the toner particle.

As described above, the aqueous medium preferably contains a dispersant.

The dispersant may be, for example, a surfactant, a poorly-water-soluble inorganic compound, or a polymeric protection colloid. Two or more of these materials can be used in combination. Among these materials, surfactants are preferable.

Surfactants include anionic surfactants, cationic surfactants, nonionic surfactants, and ampholytic surfactants.

Specific preferred examples of suitable anionic surfactants include, but are not limited to, alkylbenzene sulfonate, α-olefin sulfonate, and phosphate. In particular, anionic surfactants having a fluoroalkyl group are preferable. Specific preferred examples of suitable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl (C6-C16) ethyl phosphates. Specific examples of commercially available such anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific preferred examples of suitable cationic surfactants include, but are not limited to, amine salt type surfactants and quaternary ammonium salt type surfactants. Specific examples of the amine salt type surfactants include, but are not limited to, alkylamine salts, amino alcohol fatty acid derivatives, polyamine fatty acid derivatives, and imidazoline. Specific examples of the quaternary ammonium salt type surfactants include, but are not limited to, alkyl trimethyl ammonium salt, dialkyl dimethyl ammonium salt, alkyl dimethyl benzyl ammonium salt, pyridinium salt, alkyl isoquinolinium salt, and benzethonium chloride. Additionally, aliphatic primary, secondary, and tertiary amine acids having a fluoroalkyl group; and aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts are also preferable as cationic surfactants.

Specific examples of commercially available such cationic surfactants having a fluoroalkyl group include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Specific preferred examples of suitable nonionic surfactants include, but are not limited to, fatty acid amide derivatives and polyol derivatives.

Specific preferred examples of suitable ampholytic surfactants include, but are not limited to, alanine, dodecyl di(aminoethyl)glycine, di(octyl aminoethyl)glycine, and N-alkyl-N,N-dimethyl ammonium betaine.

Specific preferred examples of suitable poorly-water-soluble inorganic compounds include, but are not limited to, tricalcium phosphate, calcium carbonate, titanium oxide, colloidal silica, and hydroxyapatite.

Specific preferred examples of suitable polymeric protection colloids include, but are not limited to, homopolymers and copolymers obtained from monomers, such as acid monomers, acrylate and methacrylate monomers having hydroxyl group, vinyl alcohol monomers, vinyl ether monomers, vinyl carboxylate monomers, amide monomers and methylol compounds thereof, chloride monomers, and/or monomers containing nitrogen or a nitrogen-containing heterocyclic ring; and polyoxyethylenes and celluloses.

Specific examples of the acid monomers include, but are not limited to, acrylic acid, methacrylic acid, α-cyanoacrylic acid, α-cyanomethacrylic acid, itaconic acid, crotonic acid, fumaric acid, maleic acid, and maleic anhydride. Specific examples of the acrylate and methacrylate monomers having hydroxyl group include, but are not limited to, β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, and N-methylol methacrylamide. Specific examples of the vinyl ether monomers include, but are not limited to, vinyl methyl ether, vinyl ethyl ether, and vinyl propyl ether. Specific examples of the vinyl carboxylate monomers include, but are not limited to, vinyl acetate, vinyl propionate, and vinyl butyrate. Specific examples of the amide monomers include, but are not limited to, acrylamide, methacrylamide, and diacetone acrylamide. Specific examples of the chloride monomers include, but are not limited to, acrylic acid chloride and methacrylic acid chloride. Specific examples of the monomers containing nitrogen or a nitrogen-containing heterocyclic ring include, but are not limited to, vinyl pyridine, vinyl pyrrolidone, vinyl imidazole, and ethylene imine. Specific examples of the polyoxyethylenes include, but are not limited to, polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester. Specific examples of the celluloses include, but are not limited to, methyl cellulose, hydroxyethyl cellulose, and hydroxypropyl cellulose.

A dispersion stabilizer is also usable when preparing the dispersion. Specific preferred examples of suitable dispersion stabilizers include, but are not limited to, acid-soluble or alkali-soluble compounds such as calcium phosphate.

In a case in which a dispersion stabilizer is used, the resulting toner particles are first washed with an acid (e.g., hydrochloric acid) or an alkali and then washed with water. Alternatively, such a dispersion stabilizer can be removed with an enzyme.

A catalyst for the elongation and/or cross-linking reaction is also usable when preparing the dispersion. Specific examples of the catalyst include, but are not limited to, dibutyltin laurate and dioctyltin laurate.

To further reduce the viscosity of the toner components liquid to obtain toner particles with a narrower size distribution, solvents which can dissolve the urea-modified polyester (i) and the prepolymer (A) are usable. The solvents are preferably volatile because volatile solvents are easily removable.

Specific preferred examples of suitable solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. Among these solvents, aromatic solvents (e.g., toluene, xylene) and halogenated hydrocarbons (e.g., methylene chloride, 1,2-dichloroethane, chloroform, carbon tetrachloride) are preferable, and the aromatic solvents are most preferable.

The used amount of the solvent is preferably 0 to 300 parts by weight, more preferably 0 to 100 parts by weight, and most preferably 25 to 70 parts by weight, based on 100 parts by weight of the prepolymer (A). The solvent is removed by application of heat at normal or reduced pressures after the termination of the elongation and/or cross-linking reaction.

The elongation and/or cross-linking reaction time between the prepolymer (A) and the amine (B) is preferably 10 minutes to 40 hours, and more preferably from 3 to 24 hours. The reaction temperature is preferably from 0 to 150° C., and more preferably 40 to 98° C. A catalyst (e.g., tertiary amines such as triethylamine, imidazole) can be used, if needed.

The solvent can be removed from the dispersion by gradually heating the dispersion to completely evaporate the solvent from liquid droplets. Alternatively, the solvent can be removed from the dispersion by spraying the dispersion into dry atmosphere to completely evaporate the solvent from liquid droplets. In the latter case, aqueous dispersants, if any, can also be evaporated. The dry atmosphere into which the dispersion is sprayed may be, for example, air, nitrogen gas, carbon dioxide gas, or combustion gas, which is heated to above the maximum boiling point among the solvents. Such a treatment can be reliably performed by a spray drier, a belt drier, or a rotary kiln, within a short period of time.

In a case in which the dispersion is subjected to washing and drying treatments while containing toner particles having a wide size distribution, the toner particles are preferably subjected to a classification treatment thereafter.

Specifically, the classification treatment removes undesired-size particles from the resulting particles in a liquid by a cyclone, a decanter, or a centrifugal separator. Of course, the classification treatment can be performed after drying the resulting particles, but is more effectively performed in a liquid. The collected undesired-size particles, either in dry or wet condition, can be reused for preparation of toner particles.

The dispersant is preferably removed from the dispersion as soon as possible, for example, in the process of the classification treatment.

The dried toner particles are optionally mixed with fine particles of a release agent, a charge controlling agent, a fluidizer, and/or a colorant, and these fine particles can be fixedly adhered to the surfaces of the toner particles by application of mechanical impulsive force.

Mechanical impulsive force can be applied by agitating toner particles using blades rotating at a high speed, or accelerating toner particles by a high-speed airflow to collide with a collision plate. Such a treatment can be performed by ONG MILL (from Hosokawa Micron Co., Ltd.), a modified I TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Specific examples of usable colorants include, but are not limited to, carbon black, lamp black, iron black, Ultramarine Blue, Nigrosine dyes, Aniline Blue, Phthalocyanine Blue, Phthalocyanine Green, Hansa Yellow G, Rhodamine 6C Lake, Calco Oil Blue, Chrome Yellow, Quinacridone Red, Benzidine Yellow, and Rose Bengal. Two or more of such colorants can be used in combination.

The toner may include a magnetic material such as iron oxides (e.g., ferrite, magnetite, maghemite), metals (e.g., iron, cobalt, nickel), and alloys of these metals with other metals. Two or more of these magnetic materials can be used in combination. The magnetic materials are also usable as colorants.

The colorant particles dispersed in the toner preferably have a number average particle diameter of 0.5 μm or less, more preferably 0.4 μm or less, and most preferably 0.3 μm or less. When the number average particle diameter is too large, the resulting image may have poor transparency because the colorant particles cannot be finely dispersed. Colorant particles having a particle diameter of 0.1 μm or less do not adversely affect reflection and absorption properties because the particle diameter is sufficiently smaller than the half wavelength of the visible light. Therefore, colorant particles having a particle diameter of 0.1 μm or less contribute to improvement in color reproducibility and transparency of the resulting image. When a relatively large number of colorant particles having a particle diameter of 0.5 μm or more exists in a toner image formed on an OHP sheet, it is likely that incident lights may be distributed or scattered, resulting in deterioration of brightness and saturation of the projected toner image. Moreover, when a relatively large number of colorant particles having a particle diameter of 0.5 μm or more exists, it is likely that the colorant particles release from toner particles and cause various undesired phenomena, such as fogged image, contamination, and poor cleanability. The number of colorant particles having a particle diameter of 0.7 μm or less is preferably 10% or less, more preferably 5% or less, based on total number of colorant particles.

The colorant may be previously kneaded with at least a part of a binder resin along with a moist liquid, so that the colorant and the binder resin are sufficiently adherent to each other from the initial stage to make the colorant be finely dispersed in the resin in the succeeding processes.

Specific preferred examples of suitable binder resins to be kneaded with the colorant include, but are not limited to, the above-described binder resins suitable for the toner.

Specifically, the colorant, binder resin, and moist liquid may be mixed with a blender (e.g., HENSCHEL MIXER), and the mixture may be kneaded with a kneader (e.g., two-roll kneader, three-roll kneader) at a temperature lower than the melting point of the binder resin.

The moist liquid is selected considering whether the binder resin is soluble or wettable. To improve dispersibility of the colorant, the moist liquid is preferably selected from water or an organic solvent such as acetone, toluene, and butanone. In particular, water is most preferable as the moist liquid from the viewpoint of environmental consciousness and improvement of dispersibility of the colorant.

The above-described treatment makes colorant particles be finely and uniformly dispersed in the toner, the projected image of which is more bright and vivid.

The toner according to exemplary embodiments further includes a wax. The wax preferably has a melting point of 40 to 160° C., and more preferably 50 to 120° C. When the melting point is too low, heat-resistant storage stability of the toner may be poor. When the melting point is too high, cold offset resistance of the toner may be poor.

The wax preferably has a melt-viscosity of 5 to 1,000 cps, more preferably 10 to 100 cps, at a temperature 20° C. higher than the melting point. When the melt-viscosity is too large, hot offset resistance and low-temperature fixability of the toner may be poor.

The content of the wax in the toner is preferably 0 to 40% by weight, and more preferably 3 to 30% by weight.

The wax has a polar group. The toner including such a wax having a polar group is more varnish-wettable.

Specific preferred examples of suitable waxes include, but are not limited to, plant waxes such as carnauba wax, rice wax, candelilla wax, and soy wax; and synthetic waxes such as Fischer-Tropsch wax having a polar group, polyethylene wax, fatty and oily synthetic waxes (e.g., esters, ketones, amides), and hydrogenated wax; and oxidized waxes. Additionally, nonpolar paraffin waxes may be used in combination with the above-described waxes.

The toner may further include a charge controlling agent. The toner including a charge controlling agent can be quickly charged. Suitable charge controlling agents are preferably selected from colorless or white materials because colored materials may change the color tone of the toner.

Specific preferred examples of suitable charge controlling agents include, but are not limited to, triphenylmethane dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives.

Specific examples of commercially available charge controlling agents include, but are not limited to, BONTRON® P-51 (quaternary ammonium salt), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.; and quinacridone, azo pigments, and polymers having a functional group such as a sulfonate group, a carboxyl group, and a quaternary ammonium group.

The content of the charge controlling agent is preferably 0.1 to 10 parts by weight, more preferably from 0.2 to 5 parts by weight, based on 100 parts by weight of the binder resin. When the content of charge controlling agent is too large, the toner may be excessively charged and electrostatically attracted to a developing roller, resulting in poor fluidity of the developer and low image density. The charge controlling agent may be directly mixed with the binder resin or the master batch, or added to the toner components liquid. Alternatively, the charge controlling agent may be fixed on the surface of the resulting toner particles.

When preparing the toner using an aqueous medium, the aqueous medium may contain a particulate resin as a dispersion stabilizer.

The particulate resin may be comprised of a resin capable of forming an aqueous dispersion thereof. Specific examples of such resins include, but are not limited to, thermoplastic and thermosetting resins such as vinyl resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Among these resins, vinyl resin, polyurethane resin, epoxy resin, polyester resin, and combinations thereof are preferable because they are easy to form an aqueous dispersion of fine spherical particles thereof.

Specific examples of the vinyl resin include, but are not limited to, homopolymers and copolymers of vinyl monomers, such as styrene-acrylate resin, styrene-methacrylate resin, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

The toner may further include a particulate inorganic material on the surface thereof to improve fluidity, developability, and chargeability.

Specific preferred examples of suitable particulate inorganic materials include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide; magnesium oxide, zirconium oxide, barium sulfate, barium carbonate, calcium carbonate, silicon carbide, and silicon nitride.

The particulate inorganic material preferably has a primary diameter of 5 nm to 2 μm, and more preferably 5 nm to 500 nm. The particulate inorganic material preferably has a BET specific surface area of 20 to 500 $m^2/g$. The content of the particulate inorganic material is preferably 0.01 to 5% by weight, more preferably 0.01 to 2.0% by weight, based on the toner.

Additionally, particles of polymers prepared by soap-free emulsion polymerization, suspension polymerization, or dispersion polymerization (e.g., polystyrene, copolymers of methacrylates or acrylates), polycondensation polymers (e.g., silicone, benzoguanamine, nylon), and thermosetting resins are also usable as the external additive.

The toner may further include a fluidizer. The fluidizer improves hydrophobicity of the toner surface and prevents deterioration of fluidity and chargeability of the toner even under high-humidity conditions. Specific preferred examples of suitable fluidizers include, but are not limited to, silane coupling agents, silylation agents, silane coupling agents having a fluorinated alkyl group, organic titanate coupling agents, aluminum coupling agents, silicone oils, and modified silicone oils.

The toner may further include a cleanability improving agent so as to be easily removable from a photoreceptor or an intermediate transfer medium when remaining thereon after image transfer. Specific preferred examples of suitable cleanability improving agents include, but are not limited to, metal salts of fatty acids (e.g., zinc stearate, calcium stearate), and fine particles of polymers prepared by soap-free emulsion polymerization (e.g., polymethyl methacrylate, polystyrene). Such fine particles of polymers preferably have a narrow size distribution and a volume average particle diameter of 0.01 to 1 μm.

The above described spherical toner prepared by a polymerization method can reliably produce high-quality images.

Additionally, an irregular-shaped toner prepared by a pulverization method (hereinafter "pulverized toner") can also be used for the image forming apparatus according to this specification.

Specific preferred examples of suitable binder resins for pulverized toners include, but are not limited to, homopolymers of styrene or styrene derivatives (e.g., polystyrene, polyp-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-maleic acid copolymer), homopolymers and copolymers of acrylates (e.g., polymethyl acrylate, polybutyl acrylate, polymethyl methacrylate, polybutyl methacrylate), polyvinyl derivatives (e.g., polyvinyl chloride, polyvinyl acetate), polyester polymers, polyurethane polymers, polyamide polymers, polyimide polymers, polyol polymers, epoxy polymers, terpene polymers, aliphatic or alicyclic hydrocarbon resins, and aromatic petroleum resins. Two or more of these resins can be used in combination. Among these resins, styrene-acryl copolymer resins, polyester resins, polyol resins are preferable from the viewpoint of electric property and manufacturing cost, and polyester resins and polyol resins are preferable from the viewpoint of fixing property.

The pulverized toner may further include a colorant, a wax, a charge controlling agent, etc. These toner components are previously mixed as appropriate and kneaded at a temperature around the melting point of the binder resin, followed by cooling. The kneaded mixture is then pulverized into particles, and the particles are classified by size. The collected desired-size particles may be further mixed with an external additive, if needed.

The developing device may employ either a dry developing method or a wet developing method. The developing device may be either a single-color developing device or a multicolor developing device. The developing device is preferably comprised of an agitator that frictionally agitate and charge a toner or developer, and a rotatable magnet roller.

In the developing device, toner particles and carrier particles are mixed and agitated so that the toner particles are frictionally charged. The charged toner particles are and borne on the surface of the magnet roller forming chainlike aggregations (hereinafter "magnetic brush"). The magnet roller is disposed adjacent to the image bearing member. Therefore, a part of the magnetic brush formed on the surface of the magnet roller migrates to the surface of the image bearing member due to electrically attractive force. As a result, an electrostatic latent image formed on the image bearing member is developed into a toner image.

The developing device stores a developer including the above-described toner according to this specification. The developer may be either a one-component developer or a two-component developer.

The transfer process is a process which transfers a toner image from the image bearing member onto a recording medium. Preferably, the toner image is firstly transferred from the image bearing member onto an intermediate transfer medium, and secondly transferred from the intermediate transfer medium onto the recording medium. More preferably, multiple toner images with different colors are firstly transferred from the image bearing members onto the intermediate transfer medium to form a composite toner image, and the composite toner image is secondly transferred from the intermediate transfer medium onto the recording medium.

The transfer device transfers a toner image from the image bearing member by charging the image bearing member using a transfer charger. The transfer device preferably includes a primary transfer device that transfers toner images from the image bearing members onto the intermediate transfer medium to form a composite toner image, and a secondary transfer device that transfers the composite toner image from the intermediate transfer medium onto a recording medium.

The intermediate transfer medium may be, for example, a transfer belt.

Preferably, the intermediate transfer medium is conductive and has a volume resistivity of $1.0\times10^{5}$ to $1.0\times10^{11}$ Ω·cm. When the volume resistivity is too small, electric discharge may occur when a toner image is transferred from the image bearing member onto the intermediate transfer medium, probably casing toner scattering. When the volume resistivity is too large, counter charge of the toner image may remain on the intermediate transfer medium after the toner image is transferred from the intermediate transfer medium onto a recording medium, probably generating a residual image in a next image.

The intermediate transfer medium may be, for example, a belt-like or cylindrical plastic formed by kneading a thermoplastic resin with a conductive powder (e.g., tin oxide, indium oxide) and/or a conductive polymer, and extruding the kneaded mixture. Alternatively, the intermediate transfer medium may be an endless belt formed by centrifugally molding a resin liquid including a thermally-cross-linkable monomer or oligomer and an optional conductive particle or polymer described above, while applying heat thereto.

The intermediate transfer medium may have a surface layer. The surface layer may include the above-described materials suitable for the surface layer of the image bearing member except for charge transport materials, and an optional conductive material for controlling resistivity.

The transfer device (including the primary transfer device and the secondary transfer device) contains a transfer unit that charges a toner image so that the toner image separates from the image bearing member toward the recording medium. The number of the transfer device may be one or more. The transfer unit may be, for example, a corona discharger, a transfer belt, a transfer roller, a pressure transfer roller, or an adhesive transfer unit.

The recording medium is not limited to a specific material, and any kind of material can be used as the recording medium.

The fixing process is a process in which the fixing device fixes a toner image on a recording medium. Each single-color toner image may be independently fixed on a recording medium. Alternatively, a composite toner image including multiple color toner images may be fixed on a recording medium at once.

The fixing device preferably includes a heating member and a pressing member. For example, the fixing device may include a combination of a heating roller and a pressing roller, or a combination of a heating roller, a pressing roller, and an endless belt.

The heating member preferably has a temperature of 80 to 200° C.

In the fixing process, an optical fixer can be used in place of or in combination with the fixing device.

The neutralization process is a process in which the neutralization device neutralizes the image bearing member by applying a neutralization bias thereto.

The neutralization device may be, for example, a neutralization lamp.

The cleaning process is a process in which the cleaning device removes residual toner particles remaining on the image bearing member.

The cleaning device is preferably provided downstream from the transfer device and upstream from the protective layer forming device.

The cleaning device may be, for example, a magnetic brush cleaner, an electrostatic brush cleaner, a magnetic roller cleaner, a blade cleaner, a brush cleaner, or a web cleaner.

The recycle process is a process in which the recycle device supplies the residual toner particles collected in the cleaning process to the developing device.

The recycle device may be, for example, a transporter.

The control process is a process in which the control device controls the above-described processes.

The control device may be, for example, a sequencer or a computer.

After the fixing process, varnish is applied to the toner image. Varnish may be applied to the toner image immediately after the toner image is fixed on the recording medium, like in-line coaters in which both printing and coating are performed within a single apparatus. Alternatively, varnish may be applied to the toner image a short or long time after the toner image is fixed on the recording medium, like off-line coaters in which printing and coating are preformed by respective apparatuses. Varnish may be applied to entire recording medium, entire toner image, a part of recording medium, or a part of toner image. Varnish applied to the toner image can protect the surface or improve gloss.

Varnish can be applied by, for example, a roller coater, flexo coater, a rod coater, a blade, a wire bar, an air knife, a curtain coater, a slide coater, a doctor knife, a screen coater, a gravure coater (e.g., an offset gravure coater), a slot coater, an extrusion coater, an inkjet coater, a liquid film coater, a normal or reverse rotation roller coater, or a lithographic coater.

Figure 2:
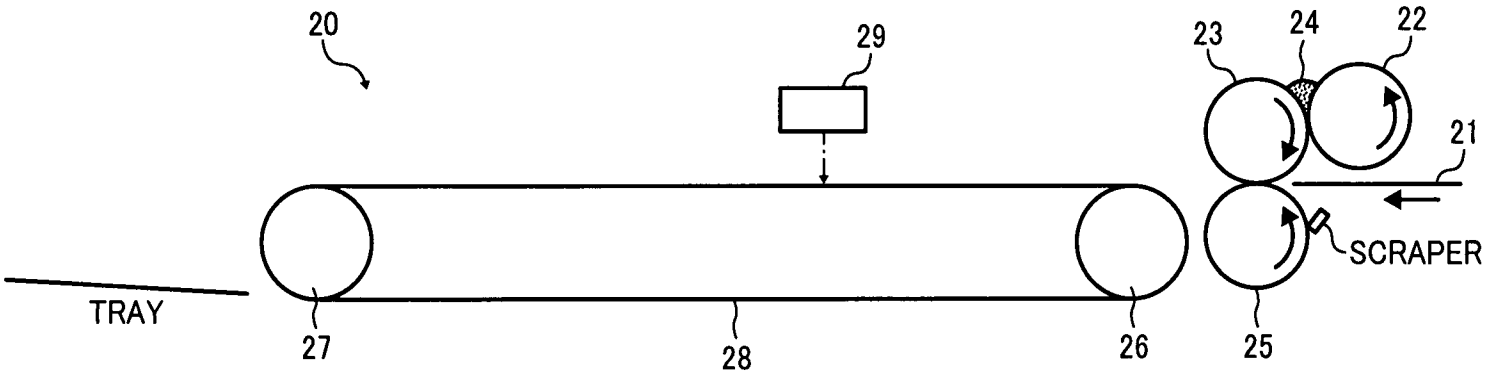
FIG. 2 schematically illustrates a varnish applicator according to exemplary embodiments of the invention.

FIG. 2 schematically illustrates a varnish applicator according to exemplary embodiments. A varnish applicator 20 includes a metal roller 22 that controls the applied amount of varnish and smoothes the applied varnish, a varnish applying roller 23 in contact with the metal roller 22, a pressing roller 25 in contact with the varnish applying roller 23, a conveyance belt 28 stretched across conveyance rollers 26 and 27, and an ultraviolet (UV) irradiator 29. A recording medium 21 having a toner image thereon passes between the varnish applying roller 23 and the pressing roller 25, while a varnish 24 is supplied to between the metal roller 22 and the varnish applying roller 23. The toner image coated with the varnish 24 is then conveyed by the conveyance belt 28 while the UV irradiator 29 dries the varnish 24, and discharged on a tray.

The varnish applicator 20 may be either mountable on the image forming apparatus 100 or usable separately. The toner image formed on the recording medium 21 is not necessarily formed by an electrophotographic apparatus as illustrated in FIG. 1, and can be formed by other apparatuses such as an inkjet apparatus.

Varnishes for use in the present invention preferably include at least one surfactant. Such varnishes may be either water-based, oil-base, or photocurable. Suitable surfactants include anionic surfactants, nonionic surfactants, silicone surfactants, and fluoro surfactants.

Specific preferred examples of suitable anionic surfactants include, but are not limited to, sulfosuccinate, disulfonate, phosphate, sulfate, sulfonate, and mixtures thereof.

Specific preferred examples of suitable nonionic surfactants include, but are not limited to, polyvinyl alcohol, polyacrylic acid, isopropyl alcohol, acetylene-based diol, ethoxylated octyl phenol, ethoxylated branched secondary alcohol, perfluorobutane sulfonate, and alkoxylated alcohol.

Specific preferred examples of suitable silicone surfactants include, but are not limited to, polyether-modified polydimethyl siloxane.

Specific preferred examples of suitable fluoro surfactants include, but are not limited to, ethoxylated nonyl phenol.

By including such surfactants, the varnish becomes more adsorptive to toners, and wettability is improved because surface tension is reduced.

Preferably, the varnish is a photocurable varnish including no harmful solvent, which can be cured so rapidly that the productivity becomes high. An exemplary photocurable varnish comprises a reactive oligomer, a reactive monomer, a sensitizer, a surfactant, and an additive.

Specific preferred examples of suitable reactive oligomers include, but are not limited to, polyvalent alcohol acrylate, epoxy acrylate, urethane acrylate, polyester acrylate, polyether acrylate, acrylate alkyd, and melamine acrylate. Two or more of these materials can be used in combination.

Specific preferred examples of suitable cross-linkable monomers include, but are not limited to, monoacrylate, diacrylate, and triacrylate.

Specific preferred examples of suitable sensitizers include, but are not limited to, anthraquinone, benzophenone, and 2-ethyl anthraquinone.

Specific preferred examples of suitable surfactants include, but are not limited to, the all surfactants described above.

Specific preferred examples of suitable additives include, but are not limited to, a leveling agent, a matting agent, a wax that controls film properties, and a tackifier that improves adhesion to recording media, such as polyolefin and PET, without inhibiting polymerization.

The photocurable varnish can be cured upon reception of energy from light sources such as low-pressure mercury lamps, middle-pressure mercury lamps, high-pressure mercury lamps, ultrahigh-pressure mercury lamps, xenon lamps, carbon arc lamps, metal halide lamps, fluorescent lamps, tungsten lamps, argon ion lasers, helium-cadmium lasers, helium-neon lasers, krypton ion lasers, semiconductor lasers, YAG lasers, light-emitting diodes, CRT light sources, plasma light sources, electron rays, y rays, ArF excimer lasers, KrF excimer lasers, and F2 lasers.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Toner 1

First, (1) 89 parts of a polyester resin (having a weight average molecular weight of 68,200 and a glass transition temperature (Tg) of 65.5° C.), (2) 5 parts of a carnauba wax, (3) 5 parts of a carbon black (#44 from Mitsubishi Chemical Corporation), and (4) 1 part of a charge controlling agent (Spilon Black TR-H from Hodogaya Chemical Co., Ltd.) were kneaded at 120° C. by a double axis extruder. The kneaded mixture was pulverized into particles by an airflow pulverizer, and the particles were classified by size so that the particles having a weight average particle diameter of 11.0 μm were collected. The collected particles were mixed with 2.20 of a silica (R-972 from Nippon Aerosil Co., Ltd.) by a HENSCHEL MIXER. Thus, a toner 1 was prepared. The toner 1 had an average circularity of 0.90 and a volume average particle diameter of 8 μm.

A carrier, comprised of magnetite particles having an average particle diameter of 50 μm covered with a silicon resin layer having a thickness of 0.5 μm, was mixed with 5.00 of the toner 1. Thus, a developer 1 was prepared.

Preparation of Varnish 1

First, 30 parts of pentaerythritol tetraacrylate, 66 parts of trimethylolpropane triacrylate, and 0.3 parts of hydroquinone (a polymerization terminator) were contained in a beaker and heated to 120° C. while being agitated, and diacryl phthalate prepolymer was dissolved therein. Further, 2 parts of aluminum isopropylate dispersed in 2 parts of toluene were gradually added thereto. The mixture was agitated for 20 minutes at 110° C. while removing the toluene therefrom. Thus, a photocurable varnish base was prepared.

Next, 75 parts of the photocurable varnish base, 10 parts of benzophenone as a sensitizer, 5 parts of p-dimethylaminoacetophenone, and 10 parts of phenyl glycol monoacrylate as an ink viscosity adjuster were mixed and kneaded by a three-roll mill. Thus, a photocurable varnish 1 was prepared.

Examples 2 and 3

Preparation of Toners 2 and 3

The procedure for preparation of the toner 1 in Example 1 was repeated except for replacing the carnauba wax with a Fischer-Tropsch wax. Thus, a toner 2 was prepared.

The procedure for preparation of the toner 1 in Example 1 was repeated except for replacing the carnauba wax with an oxidized wax. Thus, a toner 3 was prepared.

Preparation of Varnishes 2 and 3

The varnish 1 was used as it was as varnishes 2 and 3.

Example 4

Preparation of Toner 4

The procedure for preparation of the toner 1 in Example 1 was repeated except for replacing the carnauba wax with 2.5 parts of a paraffin wax and 2.5 parts of a polyethylene wax.

Thus, a toner 4 was prepared.

Preparation of Varnish 4

The varnish 1 was used as it was as a varnish 4.

Example 5

Preparation of Toner 5

The toner 1 was used as it was as a toner 5.

Preparation of Varnish 5

A water-based varnish 5 was prepared by mixing (1) 25 parts of an acrylic emulsion JONCRYL 352 (from Johnson Polymer), (2) 52 parts of an acrylic emulsion JONCRYL 741 (from Johnson Polymer), (3) 14 parts of an acrylic aqueous solution JONCRYL 60 (from Johnson Polymer), (4) 3 parts of diethylene glycol monobutyl ether acetate, and (5) 5 parts of water.

Example 6

Preparation of Toner 6

The toner 1 was used as it was as a toner 6.

Preparation of Varnish 6

A commercially available varnish CARTON CELF GW VARNISH (from DIC Corporation), comprised of a rosin-modified phenol resin varnish, a polymerized linseed oil, a light oil, and auxiliary agents (e.g., a drier, a film stiffener), in an amount of 100 parts were used as a varnish 6.

Example 7

Preparation of Toner 7

The toner 1 was used as it was as a toner 7.

Preparation of Varnish 7

The procedure for preparation of the varnish 1 in Example 1 was repeated except that the amount of the photocurable vanish base was changed to 70 parts and 5 parts of polyoxyethylene glycol alkyl ether as a surfactant were further added.

Example 8

Preparation of Toner 8

The toner 1 was used as it was as a toner 8.

Preparation of Varnish 8

The procedure for preparation of the varnish 5 in Example 5 was repeated except that the amount of the JONCRYL 741 was changed to 50 parts and 2 parts of sodium dialkyl sulfosuccinate as an anionic surfactant were further added.

Example 9

Preparation of Toner 9

The toner 1 was used as it was as a toner 9.

Preparation of Varnish 9

The procedure for preparation of the varnish 6 in Example 6 was repeated except that the amount of the CARTON CELF GW VARNISH was changed to 96 parts and 4 parts of alkylbenzene sulfonate as an anionic surfactant were further added.

Example 10

Preparation of Toner 10

Preparation of Toner Components Liquid

Preparation of Unmodified (Low-Molecular-Weight) Polyester

A reaction vessel equipped with a condenser, a stirrer, and a nitrogen inlet pipe was charged with 67 parts of ethylene oxide 2 mol adduct of bisphenol A, 84 parts of propylene oxide 3 mol adduct of bisphenol A, 274 parts of terephthalic acid, and 2 parts of dibutyltin oxide. The mixture was subjected to reaction for 8 hours at 230° C. under normal pressures.

The mixture was further subjected to reaction for 5 hours under reduced pressures of 10 to 15 mmHg. Thus, a unmodified polyester was prepared.

The unmodified polyester had a number average molecular weight (Mn) of 2,100, a weight average molecular weight (Mw) of 5,600, and a glass transition temperature (Tg) of 55° C.

Preparation of Master Batch

First, 1,000 parts of water, 540 parts of a carbon black PRINTEX 35 (from Degussa, having a DBP oil absorption of 42 ml/100 g and a pH of 9.5), and 1,200 parts of the unmodified polyester were mixed using a HENSCHEL MIXER (from Mitsui Mining and Smelting Co., Ltd.). The resulting mixture was kneaded for 30 minutes at 150° C. using a double roll, the kneaded mixture was then rolled and cooled, and the rolled mixture was then pulverized into particles using a pulverizer (from Hosokawa Micron Corporation). Thus, a master batch 1 was prepared.

Preparation of Prepolymer

A reaction vessel equipped with a condenser, a stirrer, and a nitrogen inlet pipe was charged with 682 pars of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture was subjected to reaction for 8 hours at 230° C. under normal pressures.

The mixture was further subjected to reaction for 5 hours under reduced pressures of 10 to 15 mmHg. Thus, an intermediate polyester was prepared.

The intermediate polyester had a number average molecular weight of 2,100, a weight average molecular weight of 9,600, a glass transition temperature (Tg) of 55° C., an acid value of 0.5, and a hydroxyl value of 49.

Another reaction vessel equipped with a condenser, a stirrer, and a nitrogen inlet pipe was charged with 411 parts of the intermediate polyester, 89 parts of isophorone diisocyanate, and 500 parts of ethyl acetate. The mixture was subjected to reaction for 5 hours at 100° C. Thus, a prepolymer (i.e., a polymer reactive with a compound having an active hydrogen group) was prepared.

The prepolymer was including 1.60% of free isocyanates and 50% of solid components (after being left for 45 minutes at 150° C.)

Preparation of Ketimine (Compound Having Active Hydrogen Group)

A reaction vessel equipped with a stirrer and a thermometer was charged with 30 parts of isophoronediamine and 70 parts of methyl ethyl ketone. The mixture was subjected to reaction for 5 hours at 50° C. Thus, a ketimine compound (i.e., a compound having an active hydrogen group) was prepared.

The ketimine compound had an amine value of 423.

Preparation of Styrene-Acrylic Copolymer Resin

A reaction vessel equipped with a condenser, a stirrer, and a nitrogen inlet pipe was charged with 300 parts of ethyl acetate, 300 parts of a mixture of styrene and acrylic monomers (mixing styrene, 2-ethylhexyl acrylate, acrylic acid, and 2-hydroxyethyl acrylate at a ratio of 75/15/5/5), and 10 g of azobis isobutylnitrile. The mixture was subjected to reaction for 15 hours at 60° C. in nitrogen atmosphere under normal pressures.

After adding 200 parts of methanol, the mixture was further agitated for 1 hour, followed by removing supernatant liquid and drying under reduced pressures. Thus, a styrene-acrylic copolymer resin was prepared.

In a beaker, 10 parts of the prepolymer, 60 parts of the unmodified polyester, and 30 parts of the styrene-acrylic copolymer were dissolved in 130 parts of ethyl acetate.

Further, 10 parts of a carnauba wax (having a molecular weight of 1,800, an acid value of 2.5, and a penetration of 1.5 mm (at 40° C.)) and 10 parts of the master batch were added to the beaker. The resulting mixture was then subjected to a dispersion treatment using a bead mill (ULTRAVISCOMILL (trademark) from Aimex Co., Ltd.) under the following conditions.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Further, 2.7 parts of the ketimine were added to the mixture. Thus, a toner components liquid was prepared.

Preparation of Aqueous Medium

An aqueous medium was prepared by mixing and agitating 306 parts of ion-exchange water, 265 parts of a 10% suspension of tricalcium phosphate, and 0.2 parts of sodium dodecylbenzenesulfonate.

Preparation of Emulsion Slurry

While agitating 150 parts of the aqueous medium in a vessel at a revolution of 12,000 rpm using a TK HOMOMIXER (from PRIMIX Corporation), 100 parts of the toner components liquid were added and mixed for 10 minutes. Thus, an emulsion slurry was prepared.

Removal of Organic Solvents

A flask equipped with a stirrer and a thermometer was charged with 100 parts of the emulsion slurry. The emulsion slurry was agitated for 12 hours at 30° C. at a peripheral speed of 20 m/min so that the organic solvents were removed therefrom. Thus, a dispersion slurry was prepared.

Washing and Drying

First, 100 parts of the dispersion slurry was filtered under reduced pressures, and mixed with 100 parts of ion-exchange water using a TK HOMOMIXER for 10 minutes at a revolution of 12,000 rpm, followed by filtering, thus obtaining a wet cake (i).

The wet cake (i) was mixed with 300 parts of ion-exchange water using a TK HOMOMIXER for 10 minutes at a revolution of 12,000 rpm, followed by filtering. This operation was repeated twice, thus obtaining a wet cake (ii).

The wet cake (ii) was mixed with 20 parts of a 10% aqueous solution of sodium hydroxide using a TK HOMOMIXER for 30 minutes at a revolution of 12,000 rpm, followed by filtering under reduced pressures, thus obtaining a wet cake (iii).

The wet cake (iii) was mixed with 300 parts of ion-exchange water using a TK HOMOMIXER for 10 minutes at a revolution of 12,000 rpm, followed by filtering, thus obtaining a wet cake (iv).

The wet cake (iv) was mixed with 300 parts of ion-exchange water using a TK HOMOMIXER for 10 minutes at a revolution of 12,000 rpm, followed by filtering. This operation was repeated twice, thus obtaining a wet cake (v).

The wet cake (v) was mixed with 20 parts of a 10% hydrochloric acid using a TK HOMOMIXER for 10 minutes at a revolution of 12,000 rpm, followed by filtering, thus obtaining a wet cake (vi).

The wet cake (vi) was mixed with 300 parts of ion-exchange water using a TK HOMOMIXER for 10 minutes at a revolution of 12,000 rpm, followed by filtering. This operation was repeated twice, thus obtaining a wet cake (vii).

The wet cake (vii) was dried by a drier for 48 hours at 45° C., and filtered with a mesh having openings of 75 μm. Thus, a mother toner was prepared.

External Treatment

The mother toner in an amount of 100 parts was mixed with 0.6 parts of a hydrophobized silica having an average particle diameter of 100 nm, 1.0 parts of a titanium oxide having an average particle diameter of 20 nm, and 0.8 parts of a hydrophobized silica powder having an average particle diameter of 15 nm using a HENSCHEL MIXER. Thus, a toner 10 was prepared.

The toner 10 had a weight average particle diameter of 5.7 μm and an average circularity of 0.940.

Preparation of Carrier

A coating liquid was prepared by dispersing 21.0 parts of an acrylic resin solution (including 50% of solid components), 6.4 parts of a guanamine solution (including 70% of solid components), 7.6 parts of alumina particles (having an average particle diameter of 0.3 μm and a specific resistivity of 1014 Ω·cm), 65.0 parts of a silicone resin solution (SR2410 from Dow Corning Toray Co., Ltd, including 23% of solid components), 1.0 part of an aminosilane (SH6020 from Dow Corning Toray Co., Ltd, including 100% of solid components), 60 parts of toluene, and 60 parts of butyl cellosolve, for 10 minutes using a HOMOMIXER.

The coating liquid was applied to the surface of a calcined ferrite powder ($(MgO)_{1.8}(MnO)_{49.5}(Fe_2O_3)_{48.0}$, having an average particle diameter of 35 μm) using a SPIRA COTA (from Okada Seiko Co., Ltd.), followed by drying, so that a coating layer of the acrylic and silicone resins and the alumina particles having a thickness of 0.15 μm was formed.

The ferrite powder having the coating layer was then left in an electric furnace for 1 hour at 150° C., followed by cooling.

The ferrite powder was then pulverized with a sieve having openings of 106 μm. Thus, a carrier having a weight average particle diameter of 35 μm was prepared.

To prepare a developer, 100 parts of the carrier and the 7 parts of the toner 10 were uniformly mixed using a TURBULA MIXER.

Preparation of Varnish 10

The varnish 1 was used as it was as a varnish 10.

Examples 11 and 12

Preparation of Toners 11 and 12

The procedure for preparation of the toner 10 in Example 10 was repeated except for replacing the carnauba wax with a Fischer-Tropsch wax. Thus, a toner 11 was prepared.

The procedure for preparation of the toner 10 in Example 10 was repeated except for replacing the carnauba wax with an oxidized wax. Thus, a toner 12 was prepared.

Preparation of Varnishes 11 and 12

The varnish 1 was used as it was as varnishes 11 and 12.

Example 13

Preparation of Toner 13

The procedure for preparation of the toner 10 in Example 10 was repeated except for replacing the carnauba wax with 2.5 parts of a paraffin wax and 2.5 parts of a polyethylene wax. Thus, a toner 13 was prepared.

Preparation of Varnish 13

The varnish 1 was used as it was as a varnish 13.

Examples 14 to 18

Preparation of Toners 14 to 18

The toner 10 was used as it was as toners 14 to 18.

Preparation of Varnishes 14 to 18

The varnishes 5 to 9 were used as they were as varnishes 14 to 18, respectively.

Comparative Examples 1 to 6

Preparation of Toner 21

The procedure for preparation of the toner 1 in Example 1 was repeated except for replacing the carnauba wax with a nonpolar paraffin wax. Thus, a toner 21 for use in Comparative Examples 1 to 6 was prepared.

Preparation of Varnish 21

The varnish 1 was used as it was as a varnish 21 in Comparative Example 1. The varnishes 5 to 9 were used as they were as a varnish 21 in Comparative Examples 2 to 6, respectively.

Comparative Examples 7 to 12

Preparation of Toner 22

The procedure for preparation of the toner 10 in Example 10 was repeated except for replacing the carnauba wax with a nonpolar paraffin wax. Thus, a toner 22 for use in Comparative Examples 7 to 12 was prepared.

Preparation of Varnish 22

The varnish 1 was used as it was as a varnish 22 in Comparative Example 7. The varnishes 5 to 9 were used as they were as a varnish 22 in Comparative Examples 8 to 12, respectively.

Preparation of Printings

An electrophotographic image was printed on a sheet of POD GLOSS COAT 128 g/m$^2$ (from Oji Paper Co., Ltd.) by an image forming apparatus IMAGIO MP C7500 (from Ricoh Co., Ltd.) containing each of the toners to obtain a printing.

Evaluation of Repellency

Each of the varnishes was applied to one side of the printing using an UV varnish coater (SG610V from Shinano Kenshi Co., Ltd.) so that the resulting varnish layer had a thickness of 5 g/m$^2$. When the varnish was photocurable, the varnish was cured by the coater. When the varnish was water-based or oil-based, the varnish was cured by being dried in a chamber without exposure to light. After the varnish was cured, the printing was visually observed whether the varnish was repelling or not. Repellency was graded in the following three levels.

A: Varnish was not repelling.

B: Varnish was slightly repelling, but no problem in practical use.

C: Varnish was considerably repelling.

Evaluation of Adhesiveness

Each of the varnishes was applied to one side of the printing using an UV varnish coater (SG610V from Shinano Kenshi Co., Ltd.) so that the resulting varnish layer had a thickness of 5 g/m$^2$. When the varnish was photocurable, the varnish was cured by the coater. When the varnish was water-based or oil-based, the varnish was cured by being dried in a chamber without exposure to light. After the varnish was cured, adhesiveness was evaluated based on a method according to JIS K5400. Specifically, the varnish on the printing was cut into a grid, with each section having a length of 1 mm, with a cutter knife and peeled off with an adhesive cellophane tape. The grid was visually observed to count how many sections were remaining without being peeled off. Adhesiveness was graded in the following three levels.

A+: 100 sections out of 100 sections were remaining.

A: 80 to 99 sections out of 100 sections were remaining.

B: 40 to 70 sections out of 100 sections were remaining.

C: 0 to 39 sections out of 100 sections were remaining.

The evaluation results are shown in Table 1. As is clear from Table 1, Examples 7 and 16 produced good results.

TABLE 1

| | Toner | | | Varnish | | | | Evaluation Results | |
|---|---|---|---|---|---|---|---|---|---|
| | | Wax | | | | Surfactant | | | |
| | Toner No. | Wax Type | Amount (parts) | Varnish No. | Type | Surfactant Type | Amount (parts) | Repellency | Adhesiveness |
| Example 1 | 1 | Carnauba | 5 | 1 | Photocurable | — | — | B | A |
| Example 2 | 2 | Fischer-Tropsch | 5 | 1 | Photocurable | — | — | B | A |
| Example 3 | 3 | Oxidized | 5 | 1 | Photocurable | — | — | B | A |
| Example 4 | 4 | Paraffin/Polyethylene | 2.5/2.5 | 1 | Photocurable | — | — | B | A |
| Example 5 | 1 | Carnauba | 5 | 5 | Water-based | — | — | B | A |
| Example 6 | 1 | Carnauba | 5 | 6 | Oil-based | — | — | B | A |

TABLE 1-continued

| | Toner | | | Varnish | | | | | |
|---|---|---|---|---|---|---|---|---|---|
| | | Wax | | | | Surfactant | | Evaluation Results | |
| | Toner No. | Wax Type | Amount (parts) | Varnish No. | Type | Surfactant Type | Amount (parts) | Repellency | Adhesiveness |
| Example 7 | 1 | Carnauba | 5 | 7 | Photocurable | Polyoxyethylene glycol | 5 | A | A+ |
| Example 8 | 1 | Carnauba | 5 | 8 | Water-based | Sodium dialkyl sulfosuccinate | 2 | A | A |
| Example 9 | 1 | Carnauba | 5 | 9 | Oil-based | Alkylbenzene sulfonate | 4 | A | A |
| Example 10 | 10 | Carnauba | 2.3 | 1 | Photocurable | — | — | B | A |
| Example 11 | 11 | Fischer-Tropsch | 2.3 | 1 | Photocurable | — | — | B | A |
| Example 12 | 12 | Oxidized | 2.3 | 1 | Photocurable | — | — | B | A |
| Example 13 | 13 | Paraffin/ Polyethylene | 1.15/1.15 | 1 | Photocurable | — | — | B | A |
| Example 14 | 10 | Carnauba | 2.3 | 5 | Water-based | — | — | B | A |
| Example 15 | 10 | Carnauba | 2.3 | 6 | Oil-based | — | — | B | A |
| Example 16 | 10 | Carnauba | 2.3 | 7 | Photocurable | Polyoxyethylene glycol | 5 | A | A+ |
| Example 17 | 10 | Carnauba | 2.3 | 8 | Water-based | Sodium dialkyl sulfosuccinate | 2 | A | A |
| Example 18 | 10 | Carnauba | 2.3 | 9 | Oil-based | Alkylbenzene sulfonate | 4 | A | A |
| Comparative Example 1 | 21 | Paraffin | 5 | 1 | Photocurable | — | — | C | C |
| Comparative Example 2 | 21 | Paraffin | 5 | 5 | Water-based | — | — | C | C |
| Comparative Example 3 | 21 | Paraffin | 5 | 6 | Oil-based | — | — | C | C |
| Comparative Example 4 | 21 | Paraffin | 5 | 7 | Photocurable | Polyoxyethylene glycol | 5 | C | B |
| Comparative Example 5 | 21 | Paraffin | 5 | 8 | Water-based | Sodium dialkyl sulfosuccinate | 2 | C | B |
| Comparative Example 6 | 21 | Paraffin | 5 | 9 | Oil-based | Alkylbenzene sulfonate | 4 | C | B |
| Comparative Example 7 | 22 | Paraffin | 2.3 | 1 | Photocurable | — | — | C | C |
| Comparative Example 8 | 22 | Paraffin | 2.3 | 5 | Water-based | — | — | C | C |
| Comparative Example 9 | 22 | Paraffin | 2.3 | 6 | Oil-based | — | — | C | C |
| Comparative Example 10 | 22 | Paraffin | 2.3 | 7 | Photocurable | Polyoxyethylene glycol | 5 | C | B |
| Comparative Example 11 | 22 | Paraffin | 2.3 | 8 | Water-based | Sodium dialkyl sulfosuccinate | 2 | C | B |
| Comparative Example 12 | 22 | Paraffin | 2.3 | 9 | Oil-based | Alkylbenzene sulfonate | 4 | C | B |

Additional modifications and variations of the present invention are possible in light of the above teachings. It is therefore to be understood that within the scope of the appended claims the invention may be practiced other than as specifically described herein.

What is claimed is:

1. An image forming apparatus, comprising an image bearing member to bear an electrostatic latent image;

a developing device to develop the electrostatic latent image into a toner image with a toner including a wax having a polar group; and a varnish applicator to apply a varnish to the toner image, the varnish applicator includes:

a metal roller;

an applying roller to apply the varnish including a surfactant to the toner image on a transfer medium; and a pressing roller to press against the applying roller to form a nip therebetween, through which the transfer medium having the toner image thereon passes, wherein the metal roller is provided upstream of the nip between the pressing member and the applying roller in a conveyance direction of a recording medium, and while supplying the varnish, the metal roller presses against the applying roller to form a nip therebetween provided upstream of the nip between the pressing member and the applying roller in the conveyance direction of the recording medium.

2. The image forming apparatus according to claim 1, wherein the wax comprises a plant wax having an ester group.

3. The image forming apparatus according to claim 1, wherein the wax comprises a wax having a polar group derived from a fatty acid.

4. The image forming apparatus according to claim 1, wherein the wax comprises an oxidized wax.

5. The image forming apparatus according to claim 1, wherein the varnish includes a surfactant.

6. The image forming apparatus according to claim 5, wherein the varnish is photocurable.

7. The image forming apparatus according to claim 5, wherein the surfactant is a polyoxyethylene glycol.

8. An image forming method, comprising forming a toner image on a transfer medium with a toner comprising a wax having a polar group; and applying a varnish to the toner image by utilizing the varnish applicator according to claim 1.

9. The image forming method according to claim 8, wherein the wax comprises a plant wax having an ester group.

10. The image forming method according to claim 8, wherein the wax comprises a wax having a polar group derived from a fatty acid.

11. The image forming method according to claim 8, wherein the wax comprises an oxidized wax.

12. The image forming method according to claim 8, wherein the varnish includes a surfactant.

13. The image forming method according to claim 12, wherein the varnish is photocurable.

14. The image forming method according to claim 12, wherein the surfactant is a polyoxyethylene glycol.

15. A varnish applicator, comprising:

a metal roller;

an applying roller to apply a varnish including a surfactant to a toner image on a transfer medium; and a pressing roller to press against the applying roller to form a nip therebetween, through which the transfer medium having the toner image thereon passes, wherein the metal roller is provided upstream of the nip between the pressing member and the applying roller in a conveyance direction of a recording medium, and while supplying the varnish, the metal roller presses against the applying roller to form a nip therebetween provided upstream of the nip between the pressing member and the applying roller in the conveyance direction of the recording medium.

16. The varnish applicator according to claim 15, wherein the varnish is photocurable.

17. The varnish applicator according to claim 15, wherein the surfactant is a polyoxyethylene glycol.

* * * * *